United States Patent [19]

Clayton

[11] 4,197,812

[45] Apr. 15, 1980

[54] CURTAIN COATER

[76] Inventor: A. Wiley Clayton, 1428 Maxwell La., Upland, Calif. 91786

[21] Appl. No.: 881,126

[22] Filed: Feb. 24, 1978

Related U.S. Application Data

[63] Continuation-in-part of Ser. No. 728,336, Feb. 28, 1978, Pat. No. 4,075,976, which is a continuation-in-part of Ser. No. 448,017, Mar. 4, 1974, abandoned.

[51] Int. Cl.[2] ..... B05C 5/00

[52] U.S. Cl. ..... 118/323; 118/324; 118/DIG. 4

[58] Field of Search ..... 118/324, 6, 325, 7, 118/DIG. 4, 323, 704; 53/140; 427/420

[56] References Cited

U.S. PATENT DOCUMENTS

| | | | |
|---|---|---|---|
| 1,976,539 | 10/1934 | Bonniksen | 118/DIG. 4 |
| 3,532,073 | 1/1970 | Nelson | 118/324 |
| 3,766,885 | 10/1973 | Brenner et al. | 118/DIG. 4 |

*Primary Examiner*—John P. McIntosh
*Attorney, Agent, or Firm*—Frank D. Gilliam

[57] ABSTRACT

A curtain coater includes separate infeed and outfeed conveyors defining a space. Two separate coating systems are mounted on a carriage in the space for selective movement into a coating position. Each coating system includes a separate coating head, trough for the recovery of unused coating material, and doctor blade. A chrome roll is positioned in the space for selective engagement by the doctor blades. When the first head is in the coating position, the first doctor blade engages the roll and the second doctor blade is in a storage position covering the second trough to close the second coating system. When the second coating system is in the use position, the first doctor blade is in the storage position over its trough and the second doctor blade is in its use position in engagement with the roll. A synchronous driving mechanism for the infeed conveyor, roll and outfeed conveyor includes hydraulic motors for the roll and outfeed conveyor. These hydraulic motors are coupled in series in a hydraulic circuit to insure their synchronous operation. The infeed conveyor is driven through an air clutch assembly from the roll to insure its synchronous operation with the roll.

11 Claims, 4 Drawing Figures

CURTAIN COATER

This application constitutes a continuation-in-part of my patent application Ser. No. 728,336, issued Feb. 28, 1978, as U.S. Pat. No. 4,075,976, which is a continuation-in-part of my patent application Ser. No. 448,017 filed Mar. 4, 1974, and now abandoned.

This invention relates to improvements in curtain coaters, and specifically to improved curtain coater structures for curtain coaters of the type described in my aforementioned applications.

The aforementioned U.S. patent application Ser. No. 728,336 discloses and claims a curtain coater which constitutes a substantial improvement over curtain coaters of the prior art. Specifically, the curtain coater of application Ser. No. 728,336 provides substantially greater control over various parameters of the curtain of coating material formed by a head. The quality of the curtain, of course, determines the quality of the coating applied to articles which pass beneath the coating head. The structure of application Ser. No. 728,336 provides a curtain with dramatically more reproducible and controllable curtain characteristics than prior art coaters.

However, further refinement is desirable to the coater of application Ser. No. 728,336 to minimize the amount of operator control of the various coater functions, and to add other desirable characteristics, such as automatic and substantially instantaneous coating material changeover, less of the expensive and time-consuming cleanup normally associated with coating material changeover, synchronization of infeed and outfeed control systems, and synchronization of various operations necessary to conduct a coating material changeover.

Accordingly, it is an object of the present invention to provide a curtain coater and a curtain coater control system capable of substantially instantaneously performing the various operations associated with a coating material changeover.

It is a further object of the present invention to provide an improved curtain coater coating head of the type described and claimed in the aforementioned United States Patent Application.

According to the invention, a curtain coater includes a coating head, an infeed conveyor portion for transporting material to be coated toward the coating head, an outfeed conveyor portion for transporting coating material away from the head, a space between the infeed and outfeed conveyor portions across which articles pass between the infeed and outfeed conveyors, a trough for collecting coating material which is not deposited on the articles, a roll for conveying the articles across the space and for intercepting coating material not deposited on the articles, and a doctor blade having a use position for removing coating material from the roll.

Further according to the invention, the doctor blade has a storage position out of cleaning engagement with the roll in which it covers the trough to close the trough, preventing volatile component from escaping from the coating material, and preventing contamination of the coating material from the atmosphere.

Additionally, according to the invention, the roll is rotated at sufficient speed so that the coating material falling on it when articles are not being coated is prevented from folding over upon itself and trapping air in the folds of unused coating material, thereby minimizing bubble formation in the coating material which is returned to the trough.

Also according to the invention, the infeed conveyor portion comprises a separate infeed conveyor mechanism and the outfeed conveyor portion comprises a separate outfeed conveyor mechanism. Illustratively, the separate infeed and outfeed conveyor portions are both belts. However, it should be understood that when lightweight blanks or sheets of material, such as paper carton stock or corrugated paper box stock are being coated, e.g., in a hot melt process, the infeed conveyor mechanism may constitute a pair of pinch rolls disposed closely adjacent the space through which the stock travels for coating, and the outfeed conveyor mechanism may include some sort of hold-down mechanism, such as a vacuum hold-down or air blow-down on the outfeed conveyor side to hold the coated stock on the conveyor.

Further according to the invention, a movable carriage supports the first-mentioned coating head, trough and doctor blade as an assembly separate from the infeed and outfeed conveyor portions and roll to permit the coating head, trough and doctor blade assembly to be moved from between the infeed and outfeed conveyor portions and replaced by another similar assembly for substantially instantaneous coating material changeover. Illustratively, the curtain coater comprises a second coating head and an associated second trough and doctor blade, the second coating head, trough and doctor blade being mounted on the carriage and simultaneously being moved into coating position between the infeed and outfeed conveyors as the firstmentioned coating head, trough and doctor blade are moved out of coating position. The second doctor blade is then moved into its use position in engagement with the roll as the first doctor blade is moved into its storage position covering first trough and closing the first coating material circulation system.

According to the invention, a speed control mechanism is provided for the infeed conveyor, outfeed conveyor and roll. The speed control mechanism includes a first adjustable capacity hydraulic pump and a hydraulic motor for adjustably driving the roll, a second adjustable capacity hydraulic pump and hydraulic motor for adjustably driving a coating pump associated with each of the coating heads, means for synchronously driving the first and second pumps, and means for driving the infeed conveyor and outfeed conveyor at speeds sufficient to deliver articles to be coated to, and to remove coated articles from, the roll.

Illustratively, the means for driving the outfeed conveyor includes a hydraulic motor and means for coupling the last-mentioned hydraulic motor in series with the first hydraulic motors synchronously and selectively variably to drive the outfeed conveyor and roll.

Additionally, the means for driving the infeed conveyor includes an air clutch having a driving member and a driven member, means for coupling an air start signal to the clutch, means for synchronously coupling the driving member to the roll, and means for synchronously coupling the driven member to the infeed conveyor.

Additionally, according to the invention, an improved end seal apparatus is provided for a coating head of a curtain coater of the type illustrated in application Ser. No. 728,336. The improved end seal apparatus permits flexure of the tube forming a part of such head while maintaining a sealing closure of the ends of the tube. Each end seal includes a piston providing a bearing surface in sliding engagement with an end of the tube and a cylinder slidably receiving the piston, each piston also including a side exposed to the cylinder. The coater also includes a framework supporting the cylinders, thereby supporting and locating the coating head. A supply passageway is provided for coating material through the piston and cylinder at one end of the tube, and a return passageway is provided for the coating material through the piston and cylinder at the other end of the tube. The bearing surface and cylinder side of each piston are exposed to substantially equal hydraulic pressures of coating material, but the cylinder side areas are larger than the bearing-side areas. Thus, the bearing surfaces are normally urged sealingly against the tube ends. The cylinders and pistons define regions in which coating material is likely to pool beneath the supply and return passageways, such that precipitation of solids from the coating material is likely to occur. Thus, each piston is provided with a passageway establishing a controlled leak from the pooling region between each piston and its respective cylinder into the tube at each of the tube ends to minimize precipitation and settlement effects of pooling on the coating material in these pooling regions.

The invention may best be understood by referring to the following description and accompanying drawings which illustrate the invention. In the drawings.

Figure 1:
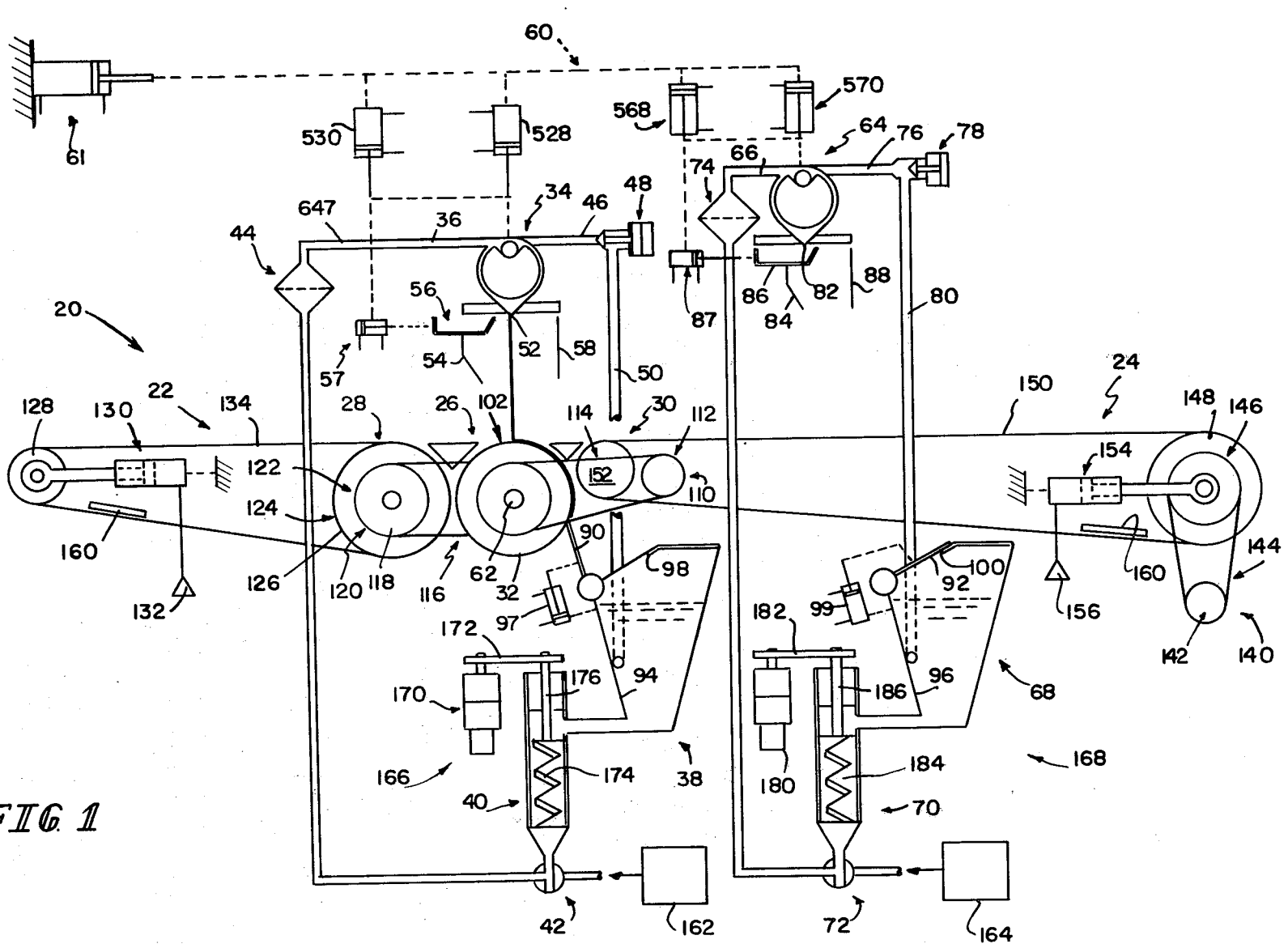
FIG. 1 is a highly diagrammatic and partly sectioned side elevational view of the infeed conveyor, roll, outfeed conveyor, and two curtain coater heads mounted on a carriage for selective positioning over the roll to coat articles selectively with the coating contained in the supply system for either the first or second head.

The curtain coater system 20 of FIG. 1 includes an infeed conveyor portion 22 and an outfeed conveyor portion 24. A space 26 between the rearward extent 28 of infeed conveyor 22 and the forward extent 30 of outfeed conveyor 24 is provided, within which is supported a roll 32 for conveying articles to be coated across the space 26. Roll 32 permits the conveyance of relatively small articles across space 26.

The system 20 further includes a first coating head 34 of the type illustrated in my aforementioned U.S. patent application Ser. No. 728,336. An inlet passageway 36 provides a supply of a first coating material from a combination collecting trough/reservoir 38 through a first progressing cavity (Moineau) pump 40, a three-way valve 42 and a coating material filter 44. The outlet passageway 46 of the first coating head 34 is coupled through a hydraulic bypass valve 48 to a bypass return line 50, which returns the first coating fluid to the collecting trough/reservoir 38 when the bypass valve 48 is open and the coating dispensing orifice 52 of head 34 is closed. A forward windscreen 54 is mounted on the underside of a movable interceptor trough 56 which is movably mounted with respect to the coating head 34 by, e.g., a hydraulic cylinder 57. A rearward windscreen 58 is supported from the underside of coating head 34.

The assembly just described including coating head 34 and its associated components is mounted upon a carriage 60, illustrated diagrammatically and in broken lines in FIG. 1. Carriage 60 is movable longitudinally of the infeed and outfeed conveyor portions 22, 24 by, e.g., a hydraulic cylinder 61 selectively to place the first coating head 34 substantially over the rotational axis 62 of roll 32 in space 26. Carriage 60 also supports a second coating head 64 in spaced-apart relation to the first coating head 34. When coating head 34 is in its use position, illustrated in FIG. 1, second coating head 64 is in a standby position. When the first coating head 34 is shifted with the carriage 60 out of its use position to a standby position, the carriage 60 moves second coating head 64 into its use position. This structure permits an almost instantaneous change in coating material being applied by the system 20. The carriage 60 shift mechanism includes linear bearings (not shown) supporting the carriage and hydraulic cylinder 61 actuable from a source of hydraulic fluid (not shown) to shift coating heads 34, 64 into their respective use and standby positions.

The inlet passageway 66 of the second coating head 64 is supplied with a second coating material from a collecting trough/reservoir 68 through a progressing cavity pump 70, a three-way valve 72 and a coating material filter 74. The outlet passageway 76 of second coating head 64 is coupled through a hydraulic bypass valve 78 and bypass return line 80 back to the collecting trough/reservoir 68. The hydraulic bypass valve 78 is actuable when the coating dispensing orifice 82 of the second coating head 64 is closed to circulate the second coating material through the system without dispensing it. This is illustrated in FIG. 1. The second coating head 64 further includes a forward windscreen 84 attached to the bottom of an interceptor trough 86 which is movably mounted from the second coating head 64 by, e.g., hydraulic cylinders 87, for selective actuation to place the interceptor trough 86 beneath the orifice 82 when the orifice 82 is closed, thereby preventing any accidental discharge of the second coating material onto the articles passing beneath heads 34, 64. The second coating head 64 also includes a rearward windscreen 88.

Each collecting trough/reservoir 38, 68 includes a doctor blade 90, 92, respectively, pivotally mounted from a forward wall 94, 96, respectively, thereof. The doctor blades 90, 92 are controlled by, e.g., hydraulic cylinders 97, 99, respectively, such that, when the first coating head 34 is in its use position, doctor blade 90 is in a use position, illustrated in FIG. 1 in contact with roll 32.

This contact between doctor blade 90 and roll 32, which is illustratively a chrome-plated roll, achieves several purposes. First, since roll 32 is being rotated upon its axis 62, it conveys the unused coating material from head 34 to doctor blade 90. Doctor blade 90 removes the excess coating material from roll 32, permitting recovery of the excess material and resulting in an economy in coating material used. Further, the doctor blade 90 carefully cleans all of the excess coating material from roll 32, avoiding the need for further cleaning of the roll 32 prior to any coating material changeover. Additionally, when the first coating head 34 is shifted on carriage 60 to its standby position, doctor blade 90 is moved by its hydraulic cylinder 97 to an orientation in which it closes the top opening 98 in collecting trough- /reservoir 38 preventing volatile components in the coating material from escaping from the collecting trough/reservoir 38. The closing of collecting trough-/reservoir 38 also prevents contamination of the first coating material by airborne particulate contaminants, etc.

Doctor blade 92 is similarly mounted and moved on its forward wall 96 selectively either to close the top opening 100 in collecting trough/reservoir 68, when the second coating head 64 is in its standby position, illustrated in FIG. 1, or to engage roll 32 to remove unused second coating material therefrom and return it to the collecting trough/reservoir 68.

An additional benefit of rotation of the roll 32 about its axis 62 is that excess coating material falls upon the roll 32 surface 102 and is conveyed at a sufficient rate to prevent the excess coating material from folding over upon itself and trapping air in its folds, thereby minimizing bubble formation in the coating material. Since bubbles are not formed in the coating material initially, no bubbles will result in the coated material returned to the troughs 38, 68. Thus, no bubbles will be dispensed from the heads 34, 64 to mar the finishes provided by heads 34, 64 on articles being coated.

The drive mechanism 110 for chrome roll 32 includes a hydraulic motor 112 and timing belt 114. Another timing belt 116 is trained about a timing wheel (not shown) provided on chrome roll 32 and engaging a timing wheel 118 of a driving member 120 of an air-actuated clutch 122. The driven member 124 of air clutch 122 is direct coupled to the driving roll 126 of infeed conveyor 22. The idler roll 128 of infeed conveyor 22 is mounted on the piston rods of pneumatic cylinders 130. Air is provided from a source 132 of compressed air to adjust the pressure in pneumatic cylinders 130, thereby adjusting the tension of the infeed conveyor 22 belt 134.

Outfeed conveyor 24 is driven by a drive mechanism 140 including a hydraulic motor 142 and timing belt 144 which is trained about the output wheel of the hydraulic motor 142 and about the timing wheel 146 of the driving roller 148 of outfeed conveyor 24. The outfeed conveyor belt 150 is trained about roller 148 and about an idler roller 152 at the forward extent 30 of outfeed conveyor 24. Driving roller 48 is mounted from the piston rods of pneumatic cylinders 154 which are coupled to a source of compressed air 156 for adjusting the tension on outfeed conveyor 24 belt 150.

Static electricity eliminators 160 are provided adjacent belts 134, 150 to eliminate static electric charge buildup on these belts and the associated components to render the system 20 as explosion-proof as possible. Such eliminators 160 are known in the art, and are frequently used since the coating materials may have volatile and highly flammable components.

Three-way valves 42, 72 are selectively operable to connect additional supplies 162, 164 of the first and second coating materials, respectively, to the first coating material system 166 and second coating material system 168, respectively, to provide make-up amounts of the first and second coating materials as necessary in the systems.

A hydraulic motor 170 includes an output shaft with a timing wheel engaged by a timing belt 172. The progressing cavity pump 40 includes a rotor 174 mounted on a drive shaft 176 carrying a timing wheel engaged by the belt 172. This mechanism drives the rotor 174. A hydraulic motor 180 including an output shaft with a timing wheel is engaged by a timing belt 182. The rotor 184 of progressing cavity pump 70 is connected by the drive shaft 186 to a timing wheel engaged by timing belt 182. This mechanism drives rotor 184.

Figure 2:
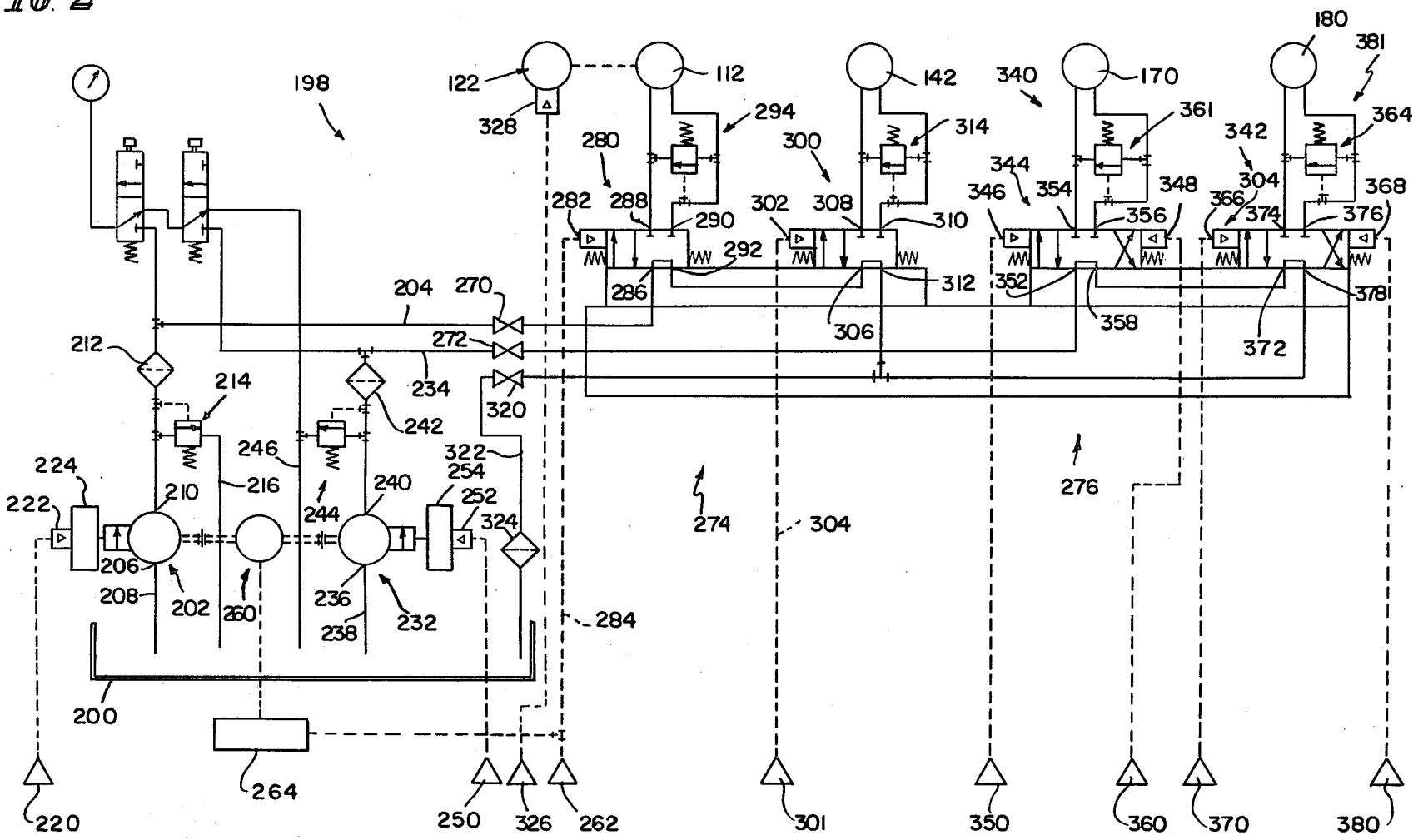
FIG. 2 is a schematic diagram of an air-actuated, high-capacity hydraulic circuit for controlling the curtain coater system of FIG. 1.

Turning now to FIG. 2, the high-capacity hydraulic system for controlling a portion of the apparatus illustrated in FIG. 1 will be described. The hydraulic system 198 of FIG. 2 includes a hydraulic fluid reservoir 200 providing a supply of hydraulic fluid. System 198 includes a variable displacement conveyor fluid supply pump 202 providing a supply of hydraulic fluid to a conveyor fluid supply line 204. Pump 202 includes an input port 206 coupled through a suction line 208 to the reservoir 200. An output port 210 of pump 202 is coupled through a filter 212 to line 204. A relief valve 214 is connected between the output port 210 and a return line 216 to reservoir 200 to prevent overpressure damage to pump 202. Pump 202 is a wobble plate-type, selectively variable displacement pump of a type in which an air signal, the pressure of which is related to a desired pump stroke volume is relayed from an air signal terminal 220 to an actuator 222 associated with a volume control 224. The volume control 224 controls the angle on the wobble plate in pump 202, thereby controlling the volume of hydraulic fluid moved per stroke of the pump.

System 198 also includes a variable displacement coating material motor supply pump 232 for supplying hydraulic fluid under pressure to the hydraulic pumps 170, 180 which drive the coating material supply pumps 40, 70 (FIG. 1). The variable displacement pump 232 supplies hydraulic fluid under pressure to a coating material hydraulic motor supply line 234. Pump 232 includes an input port 236 coupled by a suction line 238 to the reservoir 200, and an output port 240 coupled through a filter 242 to line 234. A relief valve 244 is coupled between output port 240 and a return line 246 to reservoir 200 to protect pump 232 against overpressure conditions in line 234. An air signal related to the volume of hydraulic fluid to be pumped per stroke of pump 232 is coupled to an air signal input terminal 250. This signal is relayed to an actuator 252 associated with a volume control 254 on pump 232. As with pump 202, volume control 254 controls the angle of a wobble plate in pump 232, thereby controlling the volume of hydraulic fluid pumped per stroke of pump 232.

Both of pumps 202, 232 are driven from a double end shaft electric motor 260 which is actuated from an air start signal terminal 262 through an air-to-electric interface 264. Interface 264 typically includes an air-actuated electric switch coupled to a starter solenoid for motor 260. Components 260, 264 constitute the only electric components of system 198. This feature renders the system essentially explosion-proof, which is desirable, since many of the components of the coating materials involved are volatile and highly flammable.

Lines 204, 234, respectively, are coupled through shutoff valves 270, 272 to a conveyor mechanism control portion 274 and a coating material control portion 276, respectively, of system 198.

Portion 274 includes a hydraulic control valve 280 for roll 32 hydraulic motor 112. Valve 280 is a single-piloted valve including a piloting input port 282 which is coupled to the air start signal terminal 262 through an air line 284. When an air pressure signal is present on line 284, hydraulic fluid flows from a port 286 to a port 288, and from a port 290 to a port 292, of valve 280. This flow actuates the roll 32 hydraulic motor 112. When no low pressure air signal is present on terminal 262, valve 280 is in its position illustrated in FIG. 2 and port 288 and port 290 are closed. In this position, port 286 is coupled directly to port 292. A relief valve 294 is coupled between ports 288 and 290 to protect hydraulic motor 112.

Conveyor portion 274 includes a hydraulic control valve 300, also of the single-pilot type. The piloting input signal for valve 300 is provided from a terminal 301 to the piloting input port 302 of valve 300 through an air line 304. When a low pressure air signal is present on terminal 301, hydraulic fluid is supplied from port 306 to port 308, and from port 310 to port 312, of valve 300. The flow of hydraulic fluid from port 306 to port 308 and from port 310 to port 312 actuates the hydraulic motor 142 which drives outfeed conveyor belt 150 (FIG. 1). A relief valve 314 protects hydraulic motor 142 against overpressure between ports 308 and 310. Exhaust hydraulic fluid from ports 292, 312 is coupled through a shutoff valve 320, a return line 322, and a filter 324 to reservoir 200.

A separate air signal terminal 326 is provided to control the actuator 328 of the air clutch 122. When a low pressure air signal is present on terminal 326 and hydraulic motor 112 is operating to drive roll 32 (FIG. 1), the infeed conveyor driving roll 126 is also rotating to move infeed conveyor belt 134.

Coating material portion 276 includes hydraulic system 198 further includes a hydraulic motor 170 control portion 340 and a hydraulic motor 180 control portion 342. Portion 340 includes a double-piloted hydraulic valve 344 with a "forward" piloting input port 346 and a "reverse" piloting input port 348. A low pressure air "forward" signal applied to terminal 350 of system 198 causes hydraulic fluid to flow from port 352 to port 354, and from port 356 to port 358, of valve 344. This causes a hydraulic fluid flow in a first direction through motor 170, pumping the first coating fluid from the collecting trough/reservoir 38 through pump 40. The condition of hydraulic bypass valve 48 and coating dispensing orifice 52 of coating head 34 determines whether the first coating material is dispensed from orifice 52, or merely circulates around the system. A low pressure air signal on the "reverse" air terminal 360 is coupled to the "reverse" piloting input port 348, causing hydraulic fluid to flow from port 352 to port 356, and from port 354 to port 358, of valve 344. This reverses the flow of hydraulic fluid through motor 170, causing the first coating fluid to be pumped from the progressing cavity pump 40 (FIG. 1) into the collecting trough/reservoir 38. This may be desirable when, for example, it is necessary to supply make-up coating material from storage 162 through three-way valve 42 (FIG. 1), without circulating this make-up coating material around system 166 and through coating head 34.

An overpressure relief valve 361 is coupled between ports 354, 356 to protect motor 170.

Hydraulic motor 180 control portion 342 includes a double-piloted valve 364 having a "forward" piloting input port 366 and a "reverse" piloting input port 368. Low pressure air signal at a "forward" terminal 370 is coupled to the "forward" piloting input port 366, causing hydraulic fluid to flow from port 372 to port 374 and from port 376 to port 378. This establishes a flow of hydraulic fluid through motor 180 in a first direction, causing the second coating material to flow from the collecting trough/reservoir 68 (FIG. 1) through the progressing cavity pump 70. As before, the condition of the hydraulic bypass valve 78 and coating dispensing orifice 82 of second coating head 64 determines whether the second coating material merely circulates around the system, or is actually dispensed through head 64.

Presence of a low pressure air signal at "reverse" terminal 380 is coupled to the "reverse" piloting input port 368 of valve 364, causing hydraulic fluid to flow from port 372 to port 376 and from port 374 to port 378. This induces a flow of hydraulic fluid through motor 180 in a second direction, reversing the progressing cavity pump 70 and permitting make-up second coating material to be drawn from storage 164 (FIG. 1) through the three-way valve 72 and progressing cavity pump 70 into the collecting trough/reservoir 68, without first having to circulate such make-up material through system 168.

An overpressure relief valve 381 is coupled between ports 374, 376 to protect motor 180.

Figure 3:
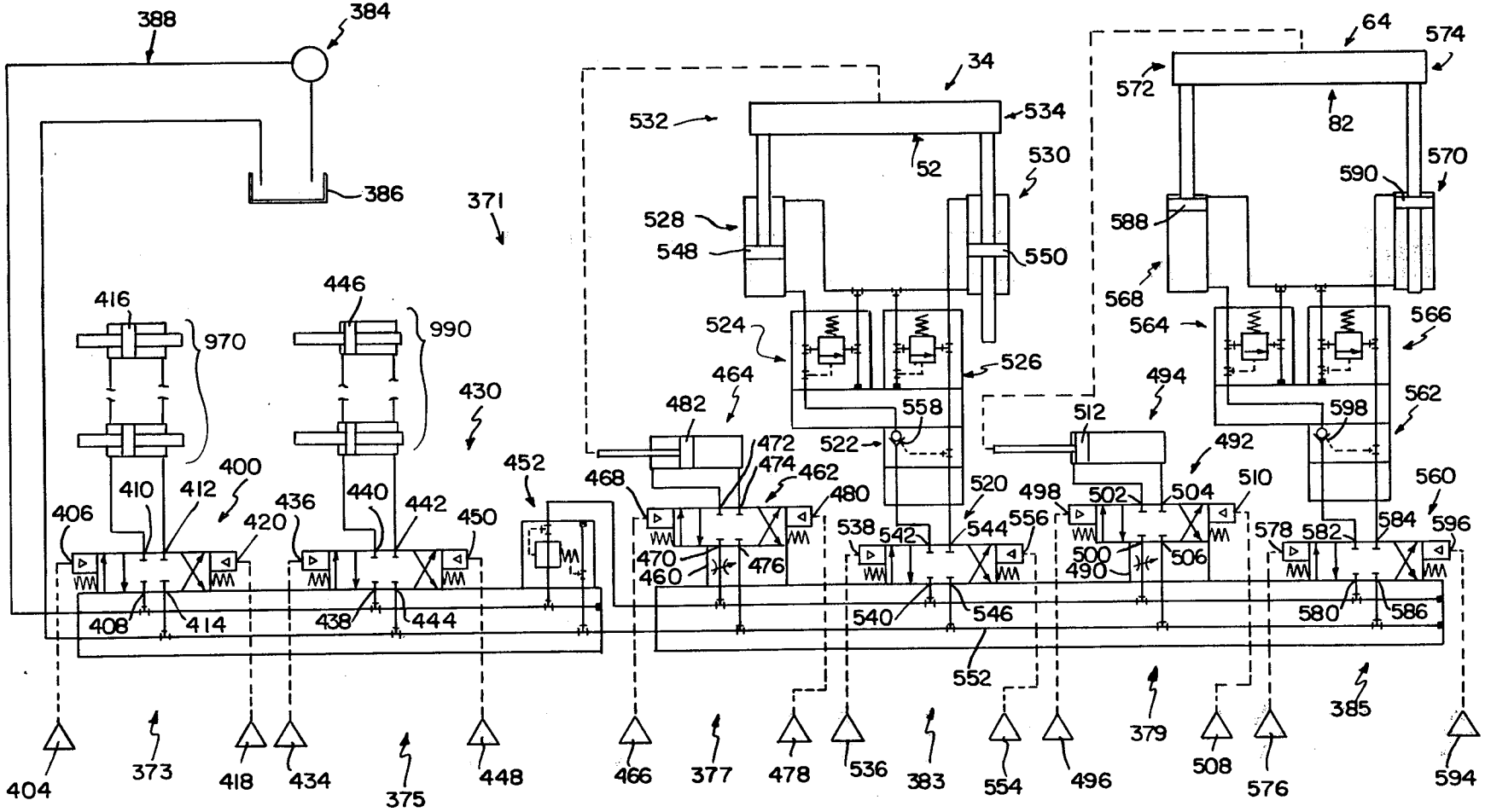
FIG. 3 is a schematic diagram of an air-operated, low-capacity hydraulic system for controlling the curtain coater system of FIG. 1.

Turning now to FIG. 3, a low-capacity hydraulic system with pneumatic control for various aspects of the operation of the curtain coater system 20 is described. The hydraulic system 371 of FIG. 3 includes a portion 373 for controlling orifice 52, a portion 375 for controlling the orifice 82, a portion 377 for controlling the minimum setting of orifice 52, a portion 379 for controlling the minimum setting of orifice 82, a portion 383 for controlling the vertical position of head 34, and a portion 385 for controlling the vertical position of head 64.

System 371 includes a pneumatically-driven pump 384 for pumping a small quantity of hydraulic fluid from a source 386 at a high pressure (e.g., 1,000 p.s.i.) to a high pressure line 388.

The control portion 373 includes a double-piloted valve 400 and hydraulic cylinders 970. A low pressure air signal present at air signal terminal 404 is coupled to a piloting input 406 of valve 400 to cause hydraulic fluid to flow from port 408 to port 410 and from port 412 to port 414 in valve 400. This flow of hydraulic fluid actuates the piston 416 in hydraulic cylinders 970 to close orifice 52. Hydraulic cylinders 970 correspond to the hydraulic cylinders 80 of application Ser. No. 728,336 for head 34. The presence of a low pressure air signal on air signal terminal 418 is coupled to the piloting input 420 of valve 400 to cause hydraulic fluid to flow from port 408 to port 412 and from port 410 to port 414, reversing the motion of piston 416 in hydraulic cylinder 970 and opening orifice 52.

The control portion 375 of hydraulic system 371 includes a double-piloted valve 430 and hydraulic cylinders 990 which corresponds to the hydraulic cylinders 80 of application Ser. No. 728,336 for head 64. Presence of a low pressure air signal on an air signal terminal 434 is coupled to a piloting input 436 of valve 430 to cause hydraulic fluid to flow from a port 438 to a port 440, and from a port 442 to a port 444, of valve 430. This hydraulic fluid flow causes the piston 446 in hydraulic cylinder 990 to close orifice 82. The presence of a low pressure air signal on air signal terminal 448 is coupled to the piloting input terminal 450 of valve 430 to cause hydraulic fluid to flow from port 438 to port 442, and from port 440 to port 444, reversing the direction of motion of piston 446 in hydraulic cylinder 990 and opening orifice 82.

A reducing pressure regulator 452 is connected to the high pressure hydraulic line 388 to reduce the pressure from the approximately 1,000 p.s.i. in line 388 to approximately 400 p.s.i. in the orifice and head control side of the hydraulic system 371.

The orifice 52 control portion 377 of hydraulic system 371 includes a variable restrictor 460 in series with a double-piloted valve 462, and a hydraulic cylinder 464. The presence of a low pressure air signal on an air signal terminal 466 is supplied to a piloting input terminal 468 of valve 462. In this condition, hydraulic fluid flows from port 470 to port 472, and from port 474 to port 476, of valve 462. A low pressure air signal on air signal terminal 478 is coupled to the piloting input terminal 480 of valve 462 to cause hydraulic fluid to flow from port 470 to port 474, and from port 472 to port 476, of valve 462. Thus, the presence of signal on terminal 466 moves the piston 482 in a first direction in hydraulic cylinder 464 to open orifice 52, and signal at terminal 478 moves piston 482 in a second direction in hydraulic cylinder 464 to close orifice 52 in head 34. This connection is illustrated diagrammatically by broken lines in FIG. 3. It should be noted that this hydraulic control system portion 377 replaces the hand crank 86 and pinion gear 87 of the head configuration described in my aforementioned application Ser. No. 728,336. The piston 482 of the instant embodiment directly drives the rack 94 described in my application Ser. No. 728,336 to adjust the head 34 orifice 52.

A duplicate arrangement is provided for the control portion 379 for orifice 82 of head 64. Specifically, this apparatus includes a variable restrictor 490, a double-piloted valve 492, and a hydraulic cylinder 494. The presence of a low pressure air signal at an air signal terminal 496 of portion 379 is coupled to the piloting input terminal 498 of valve 492 to cause hydraulic fluid to flow from port 500 to port 502, and from port 504 to port 506, of valve 492. The flow of hydraulic fluid in this direction causes the piston 512 in hydraulic cylinder 494 to move in a first direction to increase the setting of the orifice 82 in head 64 (FIG. 1). The presence of low pressure air signal at air signal terminal 508 is coupled to the piloting input terminal 510 of valve 492 to cause hydraulic fluid to flow from port 500 to port 504, and from port 502 to port 506, of valve 492. The flow of hydraulic fluid in this direction through the system causes piston 512 to move in the second direction in hydraulic cylinder 494 to decrease the setting of orifice 82 in head 64.

The head 34 vertical position portion 383 of hydraulic system 371 includes a double-piloted valve 520, a piloted check valve 522, and two overpressure relief valves 524, 526 in a head 34 height-equalizing configuration. Portion 383 further includes a pair of hydraulic cylinders 528, 530, associated with the ends 532, 534 of head 34. Cylinders 528, 530 are mounted on the carriage 60 (FIG. 1) to move the head vertically on the carriage.

Presence of a low pressure air signal on the air signal input terminal 536 is coupled to a piloting input port 538 of valve 520. The presence of this signal causes hydraulic fluid to flow from port 540 to port 542, and from port 544 to port 546, of valve 520. The fluid flows past the piloted check valve 522 in a forward direction, and into cylinder 528 beneath the piston 548 thereof. As piston 548 rises, hydraulic fluid flows from above piston 548 into hydraulic cylinder 530 beneath the piston 550 thereof. Hydraulic fluid from above piston 550 flows through ports 544 and 546 to the hydraulic fluid system 371 return line 552.

If piston 548 reaches the top of the cylinder 528 before piston 550 reaches the top of cylinder 530, relief valve 524 shorts cylinder 528 out of the hydraulic circuit, shunting hydraulic fluid directly to hydraulic cylinder 530 beneath piston 550. Piston 550 continues to rise until it reaches the top of cylinder 530, at which time relief valve 526 also opens, shorting cylinder 530 out of hydraulic circuit. Hydraulic fluid continues to flow until the signal disappears from terminal 536, at which time valve 520 returns to the neutral position illustrated in FIG. 3.

To lower head 34, a low pressure air signal is introduced at the air signal input terminal 554. This signal is coupled to the piloting input port 556 of valve 520. This condition causes hydraulic fluid to flow from port 540 to port 544, and from port 542 to port 546, of valve 520. Hydraulic fluid pressure at the piloting input port 558 of check valve 522 permits hydraulic fluid to flow into cylinder 530 above piston 550, from cylinder 530 below piston 550 to cylinder 528 above piston 548, and from beneath piston 548 through valve 520 to the return line 552.

The head 64 vertical position portion 385 of hydraulic system 371 includes a double-piloted valve 560, a piloted check valve 562, and two overpressure relief valves 564, 566 in a head 64 height-equalizing configuration. Portion 385 further includes a pair of hydraulic cylinders 568, 570, associated with the ends 572, 574 of head 64. Cylinders 568, 570 are mounted on the carriage 60 (FIG. 1) to move the head vertically on the carriage.

Presence of a low pressure air signal on the air signal input terminal 576 is coupled to a piloting input port 578 of valve 560. The presence of this signal causes hydraulic fluid to flow from port 580 to port 582, and from port 584 to port 586, of valve 560. The fluid flow past the piloted check valve 562 in a forward direction, and into cylinder 568 beneath the piston 588 thereof. As piston 588 rises, hydraulic fluid flows from above piston 588 into hydraulic cylinder 570 beneath the piston 590 thereof. Hydraulic fluid from above piston 590 flows through ports 584 and 586 to the hydraulic fluid system 371 return line 552.

If piston 588 reaches the top of the cylinder 568 before piston 590 reaches the top of cylinder 570, relief valve 564 shorts cylinder 568 out of the hydraulic circuit, shunting hydraulic fluid directly to hydraulic cylinder 570 beneath piston 590. Piston 590 continues to rise until it reaches the top of cylinder 570, at which time relief valve 566 also opens, shorting cylinder 570 out of hydraulic circuit. Hydraulic fluid continues to flow until the signal disappears from terminal 576, at which time valve 560 returns to the neutral position illustrated in FIG. 3.

To lower head 64, a low pressure air signal is introduced at the air signal output terminal 594. This signal is coupled to the piloting input port 596 of valve 560. The condition causes hydraulic fluid to flow from port 580 to port 584, and from port 582 to port 586, of valve 560. Hydraulic fluid pressure at the piloting input port 598 of check valve 562 permits hydraulic fluid to flow into cylinder 570 above piston 590, from cylinder 570 below piston 590 to cylinder 568 above piston 588, and from beneath piston 588 through valve 560 to the return line 552.

Figure 4:
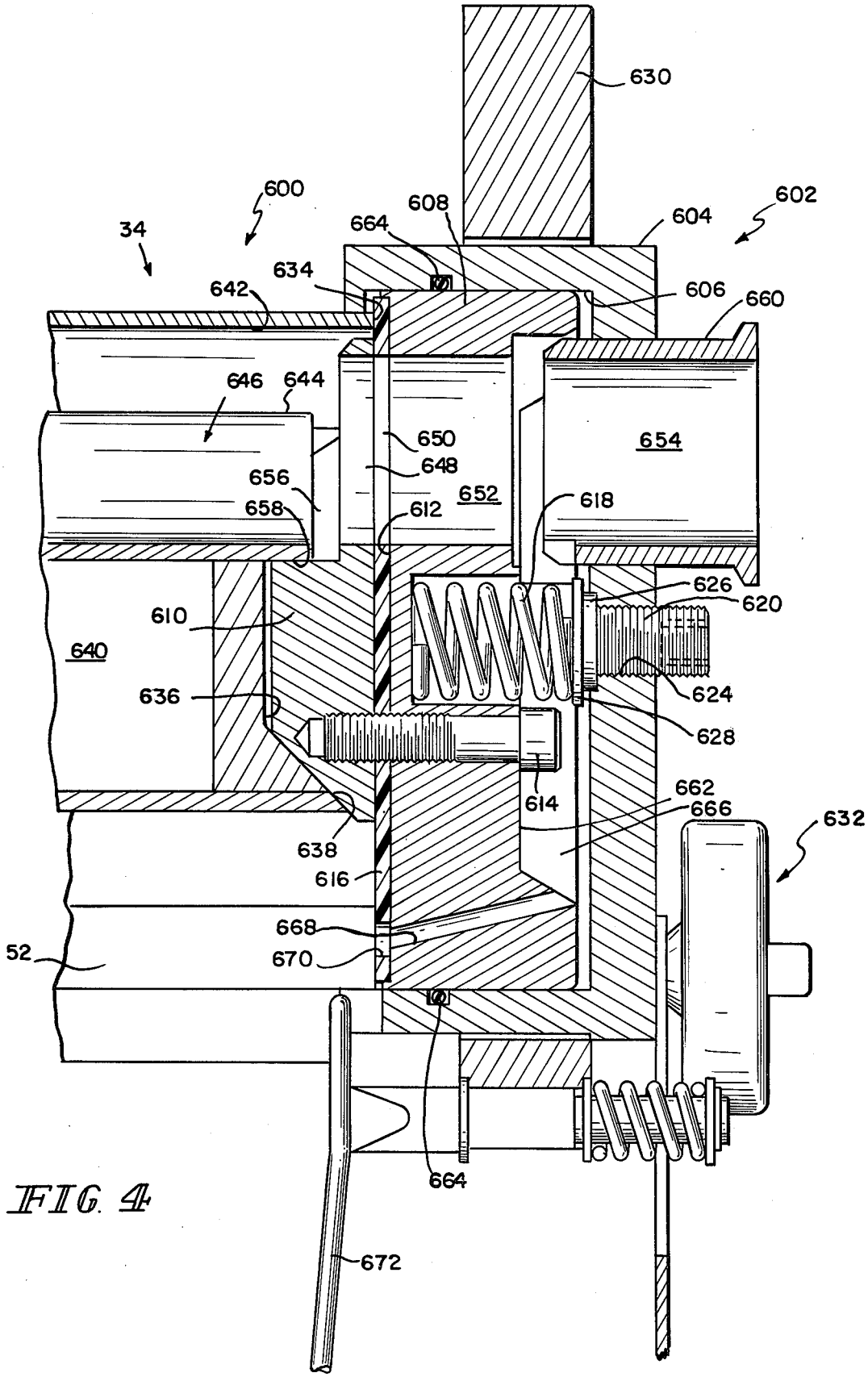
FIG. 4 is a vertical sectional view, taken longitudinally through one of the coating heads of FIG. 1, of one of the end closures for the head.

FIG. 4 corresponds to FIG. 8A of co-pending application Ser. No. 728,336. In FIG. 4, only one end of one of the tubes 600 forming the major portions of coating heads 34, 64 (FIG. 1) is illustrated. It is to be understood that a similar assembly is provided at the other end (not shown) of each tube 600.

The ends of tube 600 are closed by removable assemblies 602. Assembly 602 provides sealing that accommodates the varying shape of tube 600 as the settings of the coating dispensing orifices 52, 82 (FIG. 1) are varied. Assembly 602 includes an end flange 604 having a cylindrical portion 606 carrying a piston 608. A tapered member 610 is positioned on one face 612 of piston 608, and is secured to face 612 by cap screws 614. A flat gasket 616 constructed from, for example, polytetrafluoroethylene, is positioned between the face 612 and the adjacent surface of the tapered member 610. Piston 608 is spring-biased toward the resilient tube 600 by the arrangement of a spring 618 and bolt 620, provided in a threaded hole 624 in flange 604. A flat polytetrafluoroethylene washer 626 is retained between the head 628 of bolt 620 and flange 604 to seal the threads.

Flange 604 is connected to a head 34, 64 supporting bracket 630 by a plurality of nut and stud arrangements 632, only one of which is shown.

Gasket 616 abuts end 634 of tube 600 to effect sealing between the elements, due, in part, to the urging of spring 618. The tapered member 610 is received in a cavity 636 provided in the end 638 of the space filling tube 640, the tube 640 being accurately positioned in the flexible tube 600 by the tapered member 610. The positioning of the tube 640 within tube 600 defines passageways downwardly between the inner side walls 642 of tube 600 and the outer side wall 644 of tube 640 to the coating dispensing orifice 52, 82 (FIG. 1). These passageways conduct the flow of coating material from the trough 646 formed in the vertically uppermost portion of side wall 644 of tube 640.

The inlet passageways 36, 66 of heads 34, 64, respectively, (FIG. 1) are formed by substantially coaxial openings 648, 650, 652, 654, provided respectively in the tapered member 610, gasket 616, piston 608 and cylinder 606. As discussed in my aforementioned patent application Serial No. 728,336, a lip 656 is provided at the end 638 of the tube 640, which engages the cavity 658 provided in the tapered member 610 to restrain the tube 640 from rotating about its axis to maintain the trough 646 alignment with openings 648, 650, 652, 654. The line 647 (FIG. 1) leading from coated material filter 44 to inlet passageway 36 is attached to assembly 602 by means of the fitting 660.

Hydraulic pressure of coating material is substantially equal on gasket 616 and on face 662 of piston 608. The effective area of face 662 is, however, somewhat greater than the effective area of gasket 616 exposed to the coating material. This results in a differential force urging piston 608 and gasket 616 sealingly against the end 634 of tube 600. The force contribution of spring 618 need only be sufficient to maintain the assembly 602 in contact with tube 600 when there is no coating material in the system. It will be appreciated that, as the pressure to be contained in tube 600 increases, the force differential across piston 608 also increases, urging gasket 616 into ever tighter sealing engagement with the end of tube 600.

An O-ring gasket 664 is provided in a groove in cylinder 606 to effect sealing between piston 608 and the cylinder 606 to prevent leakage of coating material from the cylinder.

As was previously mentioned, a similar assembly (not shown) is provided at the other end of the tube 600 of each of heads 34, 64. The other assembly, of course, provides the outlet passageway 46, 76 (FIG. 1) for coating material from the heads 34, 64, respectively.

It will further be appreciated that a cavity 666 is formed between face 662 of piston 608 and the adjacent surface of the cylinder 606. Coating materials, particularly certain materials with relatively high solids content, exhibit undesirable precipitation and settling properties when they are permitted to stand or "pool". Cavity 666 is one area of the assembly 602 is which pooling and the resulting precipitation and settlement should be avoided. Further, certain coating materials tend to solidify with time. This is particularly true of some catalyzed coating materials. Hardening of such materials in cavity 666 is highly undesirable. Consequently, a downwardly sloping passageway 668 is provided in piston 608. An aligned passageway 670 is provided in the gasket 616 to establish open communication between the cavity 666 and the tube 600 adjacent the coating dispensing orifice 52, 82 (FIG. 1). Passageways 668, 670 provide a "controlled leak" from the cavity 666 to the tube 600 to minimize pooling of the coating material in cavity 666 and the resultant precipitation, settling and possible hardening. Similar passageways through the piston and gasket are provided on the assemblies (not shown) at the other ends of tubes 600 forming heads 34, 64.

It should further be noted that the controlled leak may be used to wet the curtain edge guide wire 672 to reduce the discontinuity between the velocity of the curtain at and adjacent its edge. This minimizes the possibility of curtain "fracture" disturbances at the curtain edge.

What is claimed is:

1. A curtain coater comprising a coating head, an infeed conveyor portion for transporting material to be coated toward the coating head, an outfeed conveyor portion for transporting coated material away from the head, a space between the infeed and outfeed conveyor portions across which articles pass under the head, a trough for collecting unused coating material, a roll for conveying articles across the space, a doctor blade movable between a first use position wherein it is held in contact with the roll for removing coating material therefrom and a second storage position covering the trough to close the trough to prevent volatile components from escaping from the coding material therein and includes means for moving said doctor blade between said first and second positions.

2. The apparatus of claim 1 wherein means are provided for rotating the roll at sufficient speed so that bubble formation is unused coating material falling on the roll is minimized.

3. The apparatus of claim 1 wherein the infeed conveyor portion comprises an infeed conveyor belt with selectively engageable driving means and the outfeed conveyor portion comprises a separate outfeed conveyor belt with separate driving means.

4. The apparatus of claim 1, including a movable carriage for supporting the coating head, trough and doctor blade to permit the coating head, trough, and doctor blade to be moved as an assembly while maintaining their relative operating positions from between the infeed and outfeed conveyor portions and be replaced by a like assembly for providing a substantially instantaneous coating material changeover.

5. The apparatus of claim 4 and further comprising a second coating head and an associated second trough and doctor blade, the second coating head, trough and doctor blade being mounted in a spaced apart relationship on the same movable carriage as the first-mentioned assembly for simultaneous movement into coating position between the infeed and outfeed conveyor portions as the first-mentioned coating head, trough and doctor blade are moved out of the coating position, the second doctor blade, like the first mentioned doctor blade movable between a first use position and a second storage position and includes means for moving the second doctor blade between said first and second positions.

6. The curtain coater of claim 1, additionally comprising a coating pump for pumping a coating material to the head, and a speed control mechanism comprising a first variable capacity hydraulic pump and hydraulic motor for adjustably driving the roll, a second variable capacity hydraulic pump and hydraulic motor for adjustably driving the coating pump, means for synchronously driving the first and second variable capacity pumps, and selectively engageable means for driving the infeed conveyor and separate means for driving the outfeed conveyor at speeds sufficient to deliver articles to be coated to, and to remove coated articles from, the roll.

7. The apparatus of claim 6 wherein the means for driving the outfeed conveyor includes a hydraulic motor and means for coupling the last-mentioned hydraulic motor in series with the first hydraulic motor synchronously and selectively variably to drive the outfeed conveyor and roll.

8. The apparatus of claims 4 or 6 wherein the selectively engageable driving means for driving the infeed conveyor includes an air-actuated clutch having a driving member and a driven member, means for coupling an air start signal to the clutch, means for synchronously coupling the driving member to the roll and means for synchronously coupling the driven member to the infeed conveyor.

9. The invention as defined in claim 1, wherein said curtain coater further comprises a coating material bypass system for circulating the coating material through the curtain coater when said doctor blade is in said second storage position.

10. A curtain coater comprising a coating head including a resilient tube having a longitudinally extending curtain generating orifice slot formed in its wall, means for flexing the tube side wall selectively to adjust the width of the orifice, means for holding the tube in the desired flexed orientation, an assembly for sealingly closing each end of the tube and permitting such flexure of the tube, each end closure assembly comprising a piston providing a bearing surface in sliding engagement with an end of the tube and a cylinder slidably receiving the piston, each piston also including a side exposed to the cylinder, the coater further comprising a framework supporting the cylinders and thereby supporting and locating the coating head, a support passageway for coating material provided through a piston and cylinder at one end of the tube, a return passageway provided for coating material through a piston and cylinder at the other end of the tube, the bearing surface and cylinder side of each piston being exposed to substantially equal hydraulic pressure from the coating material, the cylinder side areas being larger than the bearing side areas normally to urge the bearing surfaces sealingly against the tube ends, and the cylinders and pistons defining regions in which coating material pools beneath the supply and return passageways and means providing a controlled leak passageway from the pooling region at each of the tube ends.

11. The invention as defined in claim 10, further comprising a coating pump for pumping a coating material to the coating head, guide means positioned at the ends of said tube for defining the outer flow boundaries of said coating material leaving said tube, said controlled leak passageway continually wetting said guide means for maintaining a curtain of coating material between said guide means through an extended range of coating pump speeds.

* * * * *

UNITED STATES PATENT OFFICE

CERTIFICATE OF CORRECTION

Patent No. 4,197,812 Dated 4/15/80

Inventor(s) A. WILEY CLAYTON

It is certified that error appears in the above-identified patent and that said Letters Patent are hereby corrected as shown below:

Column 12, line 44, "coding" should be "coating", and at line 49, "is" should be "in"

Column 14, line 16, "support" should be "supply".

Signed and Sealed this

*Sixth* Day of *January 1981*

[SEAL]

*Attest:*

SIDNEY A. DIAMOND

*Attesting Officer*

*Commissioner of Patents and Trademarks*